US006484799B1

(12) United States Patent
Irish

(10) Patent No.: US 6,484,799 B1
(45) Date of Patent: Nov. 26, 2002

(54) CONTROL SYSTEM FOR MOVABLE HEAT RECOVERY COILS

(75) Inventor: John T. Irish, 121 E. Ohio, Indianapolis, IN (US) 47204

(73) Assignee: John T. Irish, Indianapolis, IN (US)

( * ) Notice: Subject to any disclaimer, the term of this patent is extended or adjusted under 35 U.S.C. 154(b) by 0 days.

(21) Appl. No.: 09/534,765

(22) Filed: Mar. 24, 2000

Related U.S. Application Data

(60) Provisional application No. 60/126,670, filed on Mar. 29, 1999.

(51) Int. Cl.[7] ..... G05D 32/00; F28D 11/00; F28F 5/00

(52) U.S. Cl. ..... 165/287; 165/47; 165/86; 122/7 R; 122/235.15

(58) Field of Search ..... 62/238.6; 165/47, 165/74, 86, 139, 200, 287; 60/39.07, 39.182; 122/169, 209.1, 235.15, 367.1, 367.2, 4 R, 7 R

(56) References Cited

U.S. PATENT DOCUMENTS

| | | | | | |
|---|---|---|---|---|---|
| 1,614,455 | A | * | 1/1927 | Cooke | 165/86 X |
| 1,649,382 | A | * | 11/1927 | Blomquist et al. | 165/86 X |
| 2,105,692 | A | * | 1/1938 | Hunicke | 165/86 |
| 2,204,144 | A | * | 6/1940 | Moore et al. | 165/86 X |
| 2,295,115 | A | * | 9/1942 | Keller | 165/86 X |
| 3,147,799 | A | * | 9/1964 | Chadburn et al. | 165/86 |
| 3,182,716 | A | * | 5/1965 | McNicol et al. | 165/86 X |
| 3,263,738 | A | * | 8/1966 | Schwamborn et al. | 165/86 X |
| 3,422,800 | A | * | 1/1969 | La Haye | 122/7 R |
| 4,151,874 | A | * | 5/1979 | Kaburagi et al. | 165/86 X |
| 4,275,310 | A | | 6/1981 | Summers et al. | 290/1 R |
| 4,307,684 | A | * | 12/1981 | Morcov | 122/7 R X |
| 4,405,013 | A | * | 9/1983 | Okamoto | 165/86 |
| 4,706,612 | A | * | 11/1987 | Moreno et al. | 122/7 R |
| 4,733,720 | A | * | 3/1988 | Havranek et al. | 165/86 X |
| 4,849,648 | A | | 7/1989 | Longardner | 290/54 |
| 4,936,109 | A | | 6/1990 | Longardner | 62/238.3 |

FOREIGN PATENT DOCUMENTS

| | | | | |
|---|---|---|---|---|
| DE | 28 24 237 B1 | * | 7/1979 | 165/86 |
| DE | 34 36 561 A1 | * | 4/1986 | 165/86 |

* cited by examiner

*Primary Examiner*—Ljiljana Ciric
(74) *Attorney, Agent, or Firm*—Clifford W. Browning; Woodard, Emhardt, Naughton, Moriarty & McNett

(57) ABSTRACT

A method and apparatus for controlling heat recovery coils in an exhaust stack. A set of heat recovery coils at least partially filled with a heat conducting fluid is positioned in a hot zone. The recovery coils are biased in a direction out of the hot zone to prevent accidental overheating in the event of a control or power failure. A heat transduction system is connected in fluid communication with the heat recovery coils. Heat energy is transferred from the hot zone into the heat conducting fluid, and the heated heat conducting fluid is then flowed into the heat transduction system where heat is removed from the heat conducting fluid. The extracted heat is then transduced into useful energy.

21 Claims, 8 Drawing Sheets

CONTROL SYSTEM FOR MOVABLE HEAT RECOVERY COILS

CROSS-REFERENCE TO RELATED APPLICATIONS

This application claims priority to U.S. Provisional Application Ser. No. 60/126,670 filed Mar. 29, 1999.

TECHNICAL FIELD OF THE INVENTION

The present invention generally relates to heat recovery devices and, more particularly, to a control system for heat recovery coils.

BACKGROUND OF THE INVENTION

Although electric power is utilized in diverse ways in the economy and demand remains high at all times, the demand for electric power nevertheless fluctuates markedly during the course of a day. Business demand is high throughout daylight hours in the operation of stores and offices, but diminishes significantly thereafter. Residential demand is highest in the evening hours. Industrial demand is relatively steady and high at all times. Other demands, such as for urban transportation, peak at differing times. Additionally, demand can vary greatly seasonally and with short-term changes in the weather. For example, electricity usage soars on abnormally hot days due to widespread use of air conditioning equipment.

In an optimized power utilization system, all such demands would be complementary and thus provide a substantially constant power requirement which could be served readily by the various sources of electric power in a readily predictable manner. In reality, however, electric power demand is nowhere near constant.

The uneven demand for electric power requires that power generation capacity be sufficiently great to accommodate the maximum instantaneous demand. This, in turn, leads to uneconomic operation of generally over-sized electric power generation facilities. One approach to this problem has been the encouragement of off-peak usage of electric power in an effort to restructure the demand pattern. Another approach has been the installation of additional generating facilities intended for use during the periods of peak power demand. For example, an electric utility may lease one or more gas turbine electric generators in order to bring on-line more power generation capacity during warmer months of the year.

One such prior art gas turbine electric generator is illustrated in FIG. 1 and indicated generally at 10. The turbine 10 is housed within a structure 12 having an air inlet 14 and an exhaust stack 16. The gases exiting the top of the exhaust stack 16 are extremely hot, typically in the neighborhood of 900° F.

This exhausted heat is energy that is not being utilized by the system, thus drastically lowering the efficiency of the turbine 10. This heat represents energy that is consumed by the turbine 10 but not turned into useful generated electricity.

Obviously, it would be desirable to recover the energy being lost as heat from the turbine 10 (or any other system that produces wasted heat exhaust) and convert this heat to a useful form. The present invention is directed toward this goal.

SUMMARY OF THE INVENTION

The present invention relates to a method and apparatus for selectively introducing one or more sets of heat transfer coils into the path of heated gasses to facilitate reclamation of at least some of the heat for transduction into useful energy. One form of the present invention is a set of coils adapted to circulate a heat-conducting fluid under pressure. The coils are in fluidic communication with a fluid chilling assembly. The coils are further adapted to be partially or completely introduced into an environment containing hot gasses (a hot zone), wherein heat is transferred from the hot gasses to the fluid circulating in the coils. The heated fluid is circulated into the chillers, where the heat is removed and transduced into a conveniently useful form of energy, such as electricity. The coils may b e only partially introduced into the hot gasses so as to optimize t he heat transfer to the coils and to prevent overheating of the heat conducting fluid and damage to the coils. The extent to which the coils are introduced into the hot gasses is variable and is a function of the temperature of the gasses and the fluid in the coils. In t he event of a power or control failure, the coils may be provided with a failsafe configuration to automatically remove them from t he hot gas environment.

One object of the present invention is to provide an improved heat energy reclamation system with an automatic failsafe to guard against accidental overheating.

Related objects and advantages of the present invention will be apparent from the following description.

DETAILED DESCRIPTION OF THE PREFERRED EMBODIMENT

Figure 1:
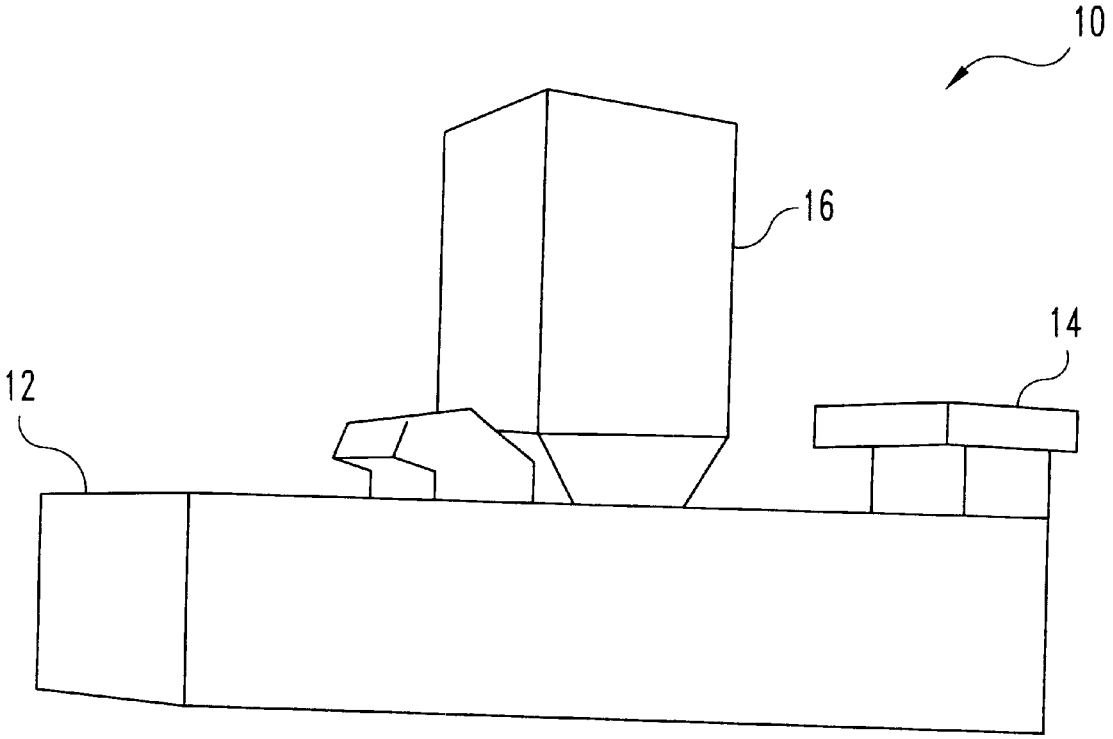
Fig. 1 (PRIOR ART)
FIG. 1 is a perspective view of a prior art gas turbine electric generator.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
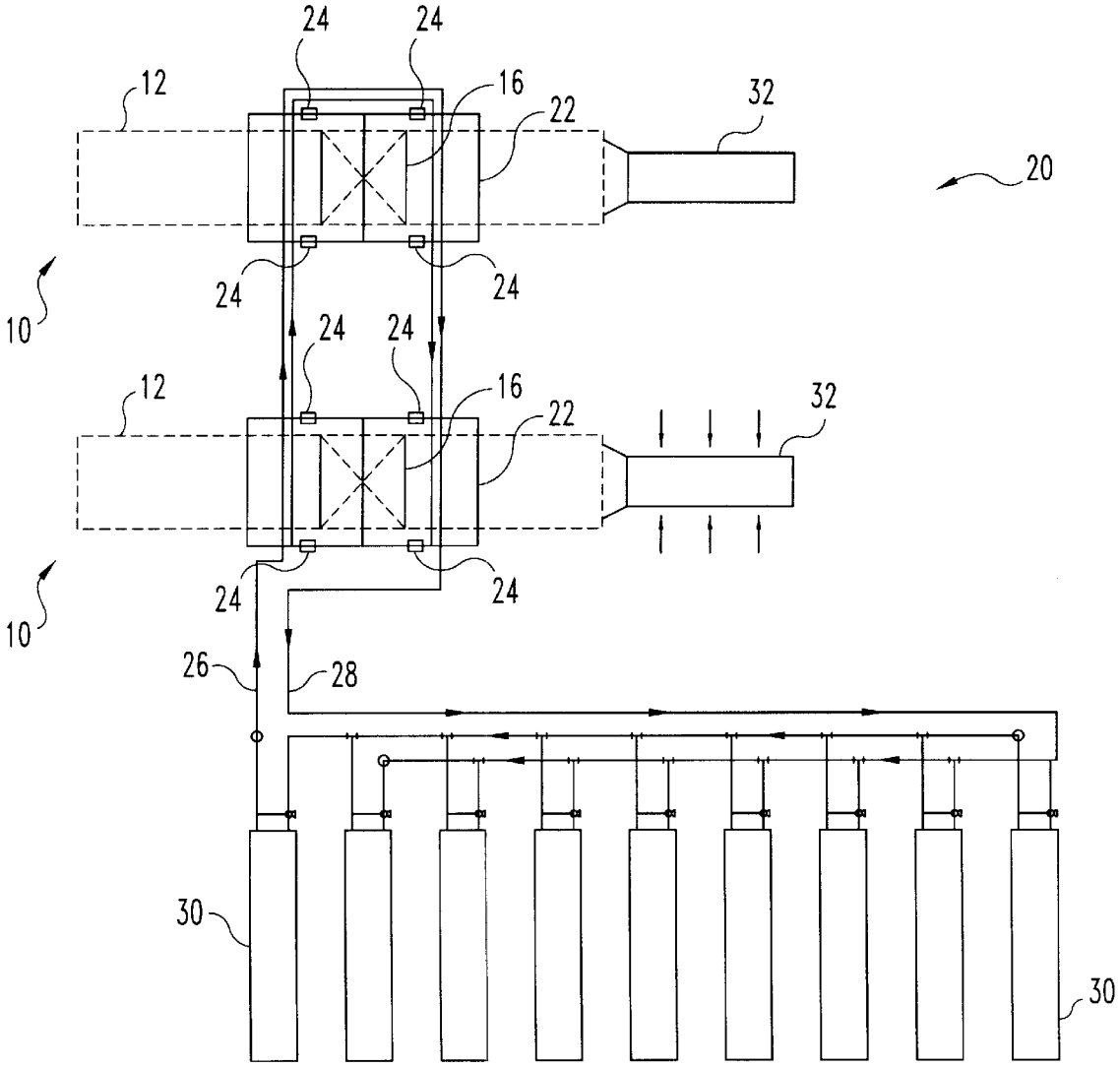
FIG. 2 is a schematic diagram of a heat recovery system of the present invention.
Figure 7:
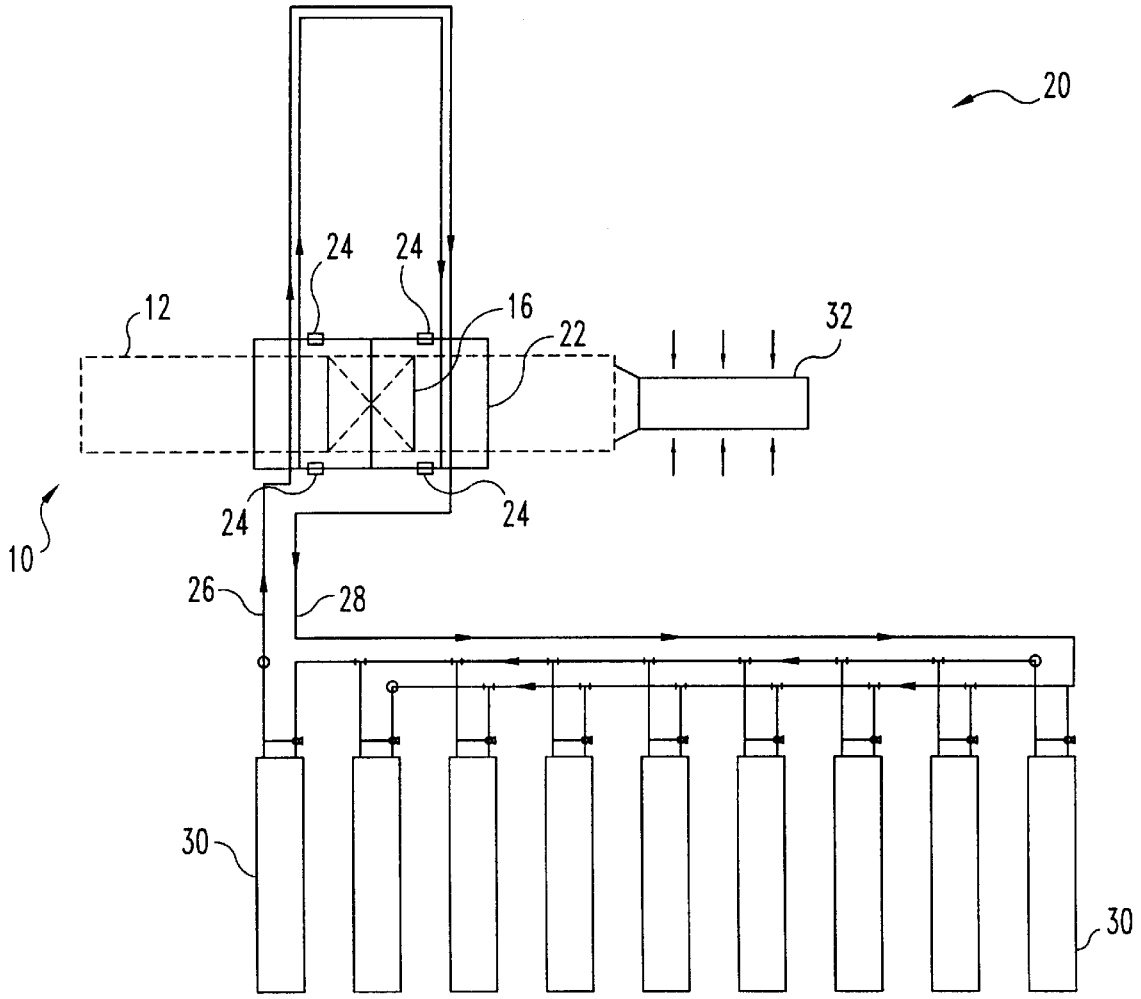
FIG. 7 is a schematic diagram of a heat recovery system according to a second embodiment of the present invention.

The use of a heat recovery system of the present invention with a pair of gas turbine electric generators 10 is illustrated schematically in FIGS. 2 and 7, and indicated generally at 20. The heat recovery system 20 is illustrated in use with two turbines 10, however it will be understood that the present invention may be used with any number of turbines 10. In fact, the heat recovery system of the present invention may be used with any heat-producing device, and may be configured to work with any number of sources of such heat.

FIG. 2 is a schematic top plan view, such that the tops of the heat exhaust stacks 16 are visible. In order to capture the heat emitted from the exhaust stacks 16, a system of heat recovery coils 22 are positioned above the stack 16 on a superstructure supported by posts 24. This allows the heat recovery coils 22 to be supported above the exhaust stacks 16 upon their own superstructure, thereby allowing the heat recovery system 20 to be installed without modification to the turbine 10. The present invention also comprehends an embodiment in which the heat recovery coils 22 are attached to the top of the exhaust stack 16 or otherwise physically integrated with the turbine 10.

As is known in the art, the heat recovery coils work on a heat exchange principle, in which a fluid heat conducting medium, such as ammonia or water, is flowed through a series of coils positioned in the path of the exhaust emitted by the exhaust stack 16, such that the fluid within the coils is heated by the exhaust. If the fluid within the coils is caused to continuously flow, the heat captured from the exhaust is moved away from the exhaust stack 16 to a place where it can be recovered (transduced) into useful energy. The use of ammonia in the heat recovery coils 20 is a preferred embodiment of the present invention; however, any heat conducting material may be used. For example, it is known in the art to use various oils for heat exchange (such as DOWTHERM manufactured by The Dow Corporation), in order to increase the temperature at which the heat recovery coils 22 may operate. It is also known in the art to pressurize the heat recovery medium, in order to allow it to absorb more heat. For example, a heat conducting liquid may be pressurized so that it may be heated to significantly higher temperatures before transitioning to a gaseous phase than would be the case if the liquid were at normal atmospheric pressure. The present invention comprehends the use of any material for the heat exchange medium.

Figure 5:
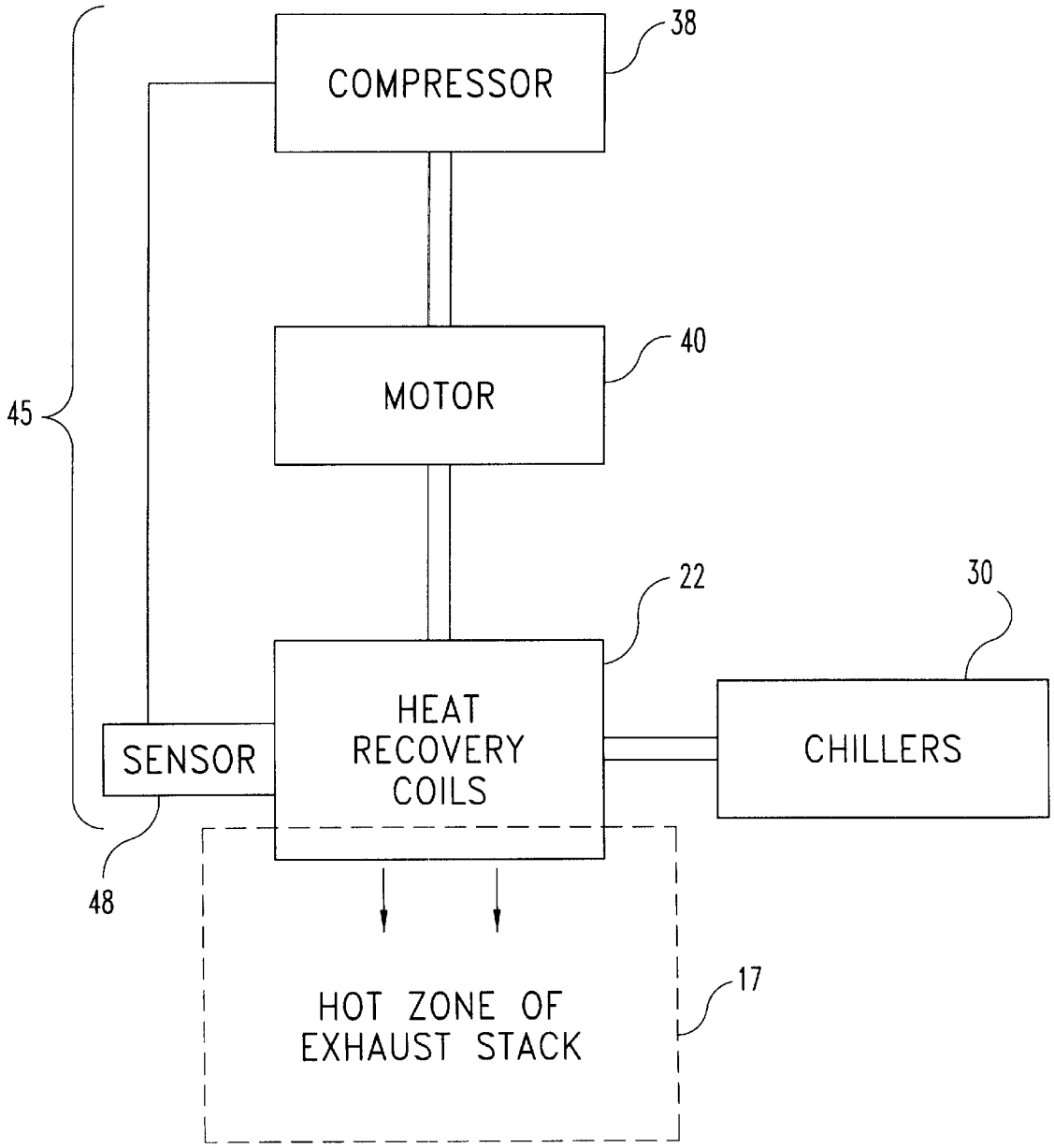
FIG. 5 is a schematic drawing illustrating the relationship of the control system to the heat recovery coils of the present invention.
Figure 6A:
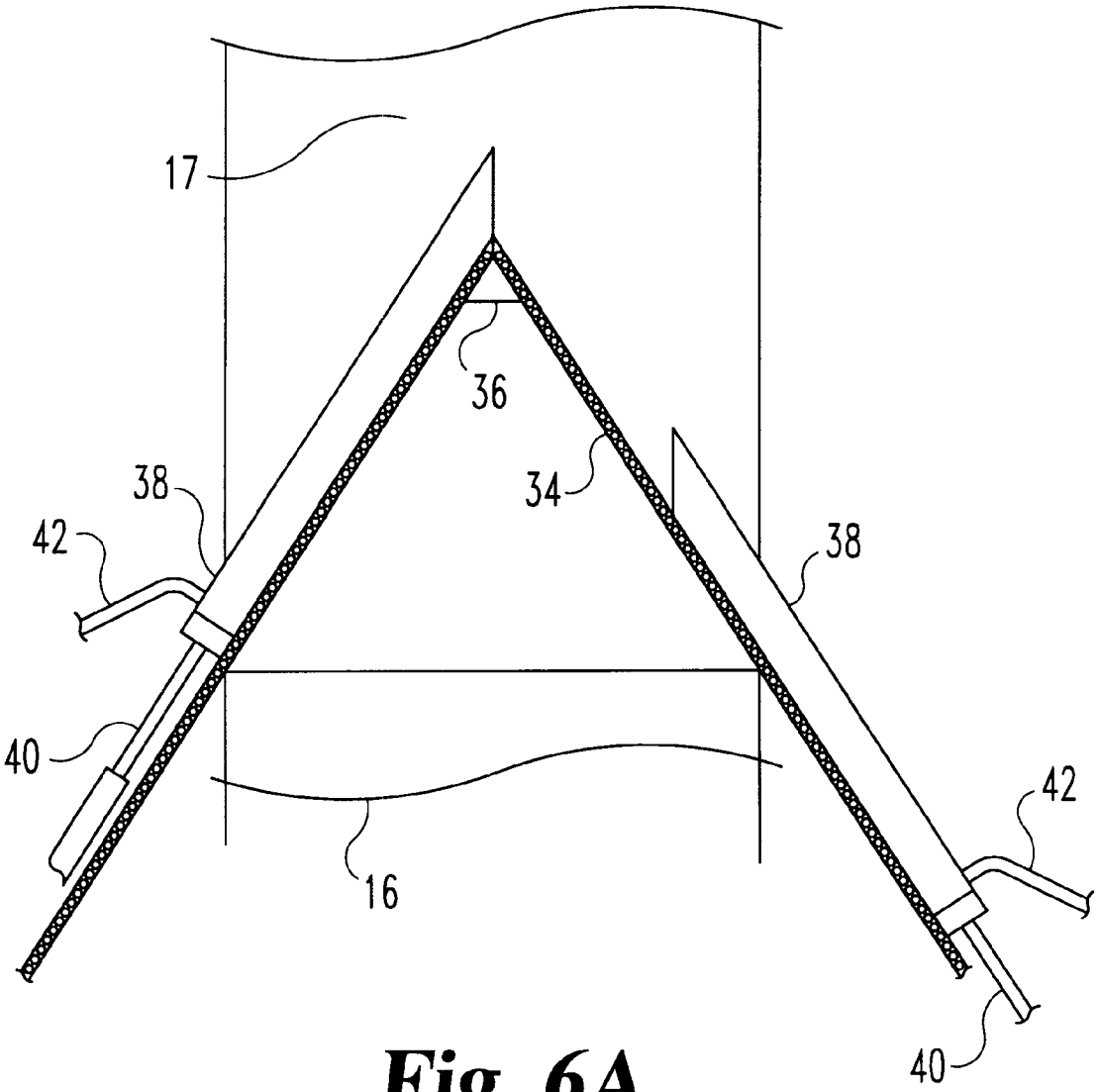
FIG. 6A is a schematic side elevational view of a first fail-safe configuration of the present invention.
Figure 6B:
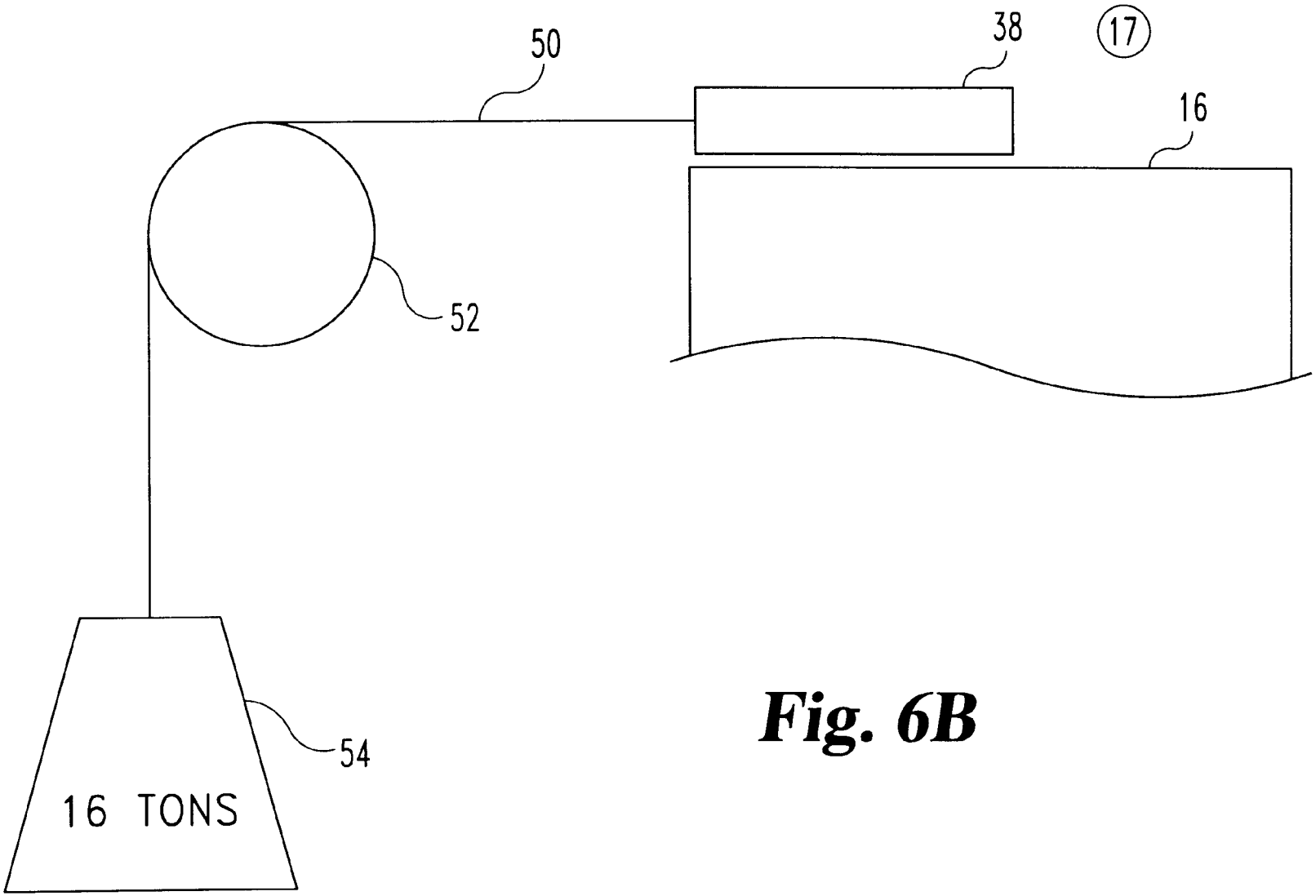
FIG. 6B is a schematic side elevational view of a second fail-safe configuration of the present invention.

In the preferred embodiment, the heat exchange fluid is pumped to the heat recovery coils 22 by means of a 16" pipe 26 and is recovered from the heat recovery coils 22 by means of a 16" return pipe 28, having been heated by the placement of the heat recovery coils 22 in the path of the heated exhaust gasses (or hot zone 17, as is illustrated in FIGS. 5, 6A and 6B). In a preferred embodiment, the fluid entering the heat recovery coils 22 is at approximately 230° F., while the fluid exiting the heat recovery coils 22 is at approximately 270° F. This 40° F. increase in the temperature of the fluid represents energy that has been recovered from the exhaust of the stacks 16. This heated fluid is pumped into one or more pump/chiller combinations 30 (heat transduction systems) fluidically connected to the heat recovery coils 22, which maintain the flow of fluid through the system and which also include chillers 30 for extracting the heat energy in the fluid, as is commonly known in the art. The number of pump/chiller units 30 required for the application depends upon the quantity of heat being recovered from the turbines 10. In a preferred embodiment, the pump/chiller units 30 are contained within trailers in order to easily allow greater capacity to be added, or capacity to be taken away.

As is known in the art, the chillers 30 extract heat energy from the fluid flowing through the heat recovery coils 22 and transduce the extracted heat energy into useful energy for any desirable purpose. For example, this energy may be placed onto the electric grid that is being fed by the turbine generators 10. As a further example, this energy may be used to power air conditioning coils 32 that are added to the air inlet 14 of each turbine 10. The coils 32 cool the inlet air to the turbine 10, thereby increasing the efficiency of the turbine 10.

One concern with the use of the heat recovery coils 22 in the path of exhaust gases as hot as those exiting the stack 16, is that if the fluid within the coils 22 is allowed to heat to too high a temperature, catastrophic failure of the system is possible. For example, if water is flowing through the heat recovery coils 22, and the temperature of the water is elevated above the boiling point of the water (at the pressure at which it is maintained), then the water will turn to steam, greatly expanding its volume and causing catastrophic failure of the system through rupture of the coils. If the temperature rise is rapid enough, steam generation may occur so quickly that the failure mechanism may even be an explosion. Such a scenario may occur if the pumping units 30 fail and the water within the heat recovery coils 22 is not flowed at a high enough rate.

Figure 3:
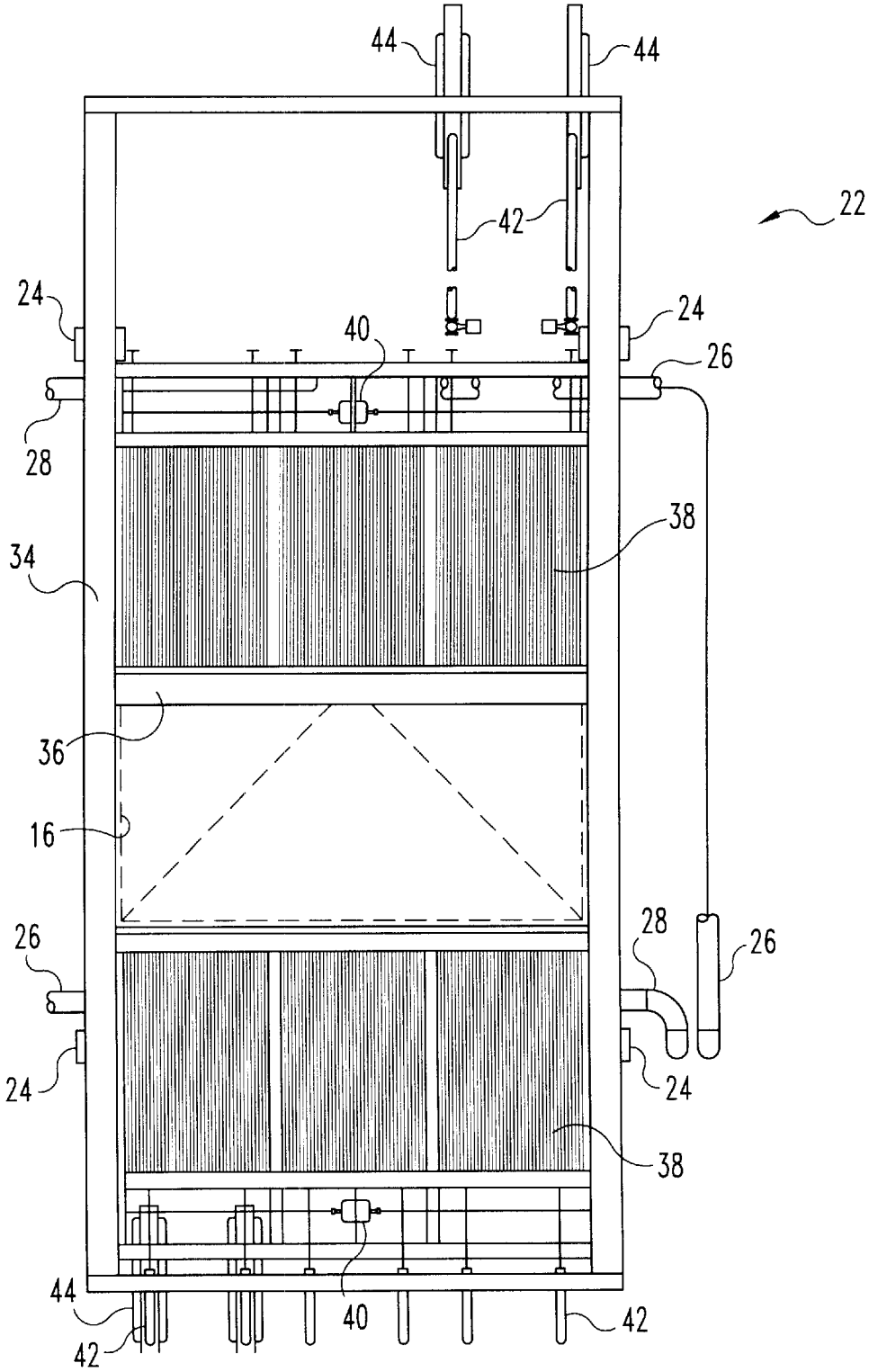
FIG. 3 is a plan view of a pair of heat recovery coil units of the present invention.

In order to guard against this problem, the present invention provides for heat recovery coils 22 as configured in FIG. 3. Visible in the view of FIG. 3 is the superstructure 34 which rests upon the posts 24 and which holds the components of the heat recovery coils 22. The superstructure 34 includes a central crossbeam 36 which crosses substantially over the centerline of the exhaust stack 16.

The heat recovery coil 22 comprises two separate coil units 38 which are independently plumbed to the inlet fluid pipes 26 and the outlet fluid pipes 28. In turn, each of the coil units 38 comprises three individual coils in the preferred embodiment. The number of coils or coil units is not critical to the present invention, and is considered to be a matter of design choice.

Each of the coil units 38 ride s upon wheels or other structures which allow it to be slid upon the side rails of the superstructure 34. In this way the coil unit 38 may be moved into or out of the path of the exhaust flow exiting the stack 16. Furthermore, the coil unit 38 may be moved partially into the exhaust flow, moved entirely into the exhaust flow, or moved completely out of the exhaust flow. Each of the two coil units 38 may be moved independently. In the view of FIG. 3, the upper coil unit 38 is shown positioned completely within the exhaust flow, while the lower coil unit 38 is shown positioned completely out of the exhaust flow. It can be seen with reference to FIG. 3 that when both coil units 38 are positioned completely within the exhaust flow, all of the exhaust produced by the stack 16 is forced to flow around the coils of the coil units 38. In a preferred embodiment, the coil units 38 are moved by means of an electric motor 40 which drives a rack and pinion system attached to the superstructure 34; however, the present invention comprehends the use of any motor means 40 for moving the coil units 38, the particular choice of coil motive means 40 not being critical to the present invention.

Because the fluid inlet pipes 26 and outlet pipes 28 are fixed and because the coil units 38 are moveable, some means must be provided for connecting these structures for fluid flow therebetween. In a preferred embodiment to the present invention, these connections are made by lengths of 5" braided stainless steel flexible hose that connect both to the inlet pipes 26/outlet pipes 28 and to the individual coils of the coil unit 38. For each coil, one flexible hose 42 is provided for the inlet and a second flexible hose 42 is provided for the outlet. Therefore, for the coil units 38 illustrated in FIG. 3, three pairs of flexible hose 42 are required for each coil unit 38 (as illustrated in relation to the lower coil unit 38); only one pair of the hoses 42 is illustrated in relation to the upper coil unit 38. As an alternative, each of the coils within the coil unit 38 may be chained together in a series, so that only one inlet hose 42 and one outlet hose 42 is required to service the entire coil unit 38.

Figure 4A:
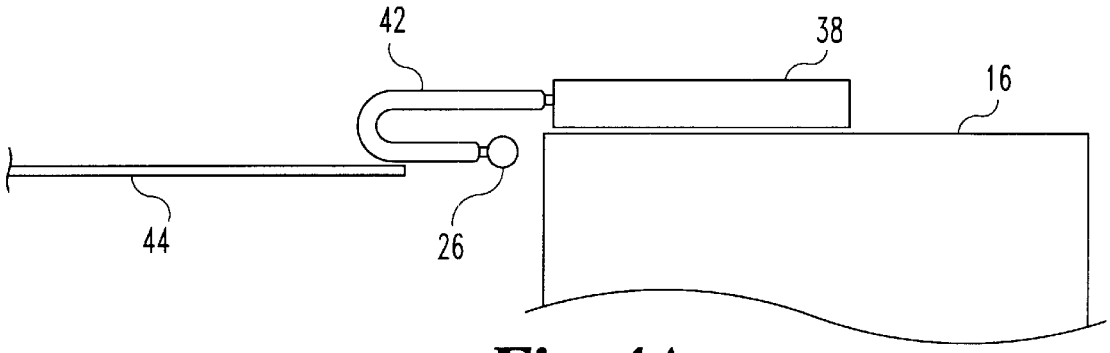
FIGS. 4A–B are schematic side elevational views of one of the heat recovery coil units of FIG. 3.
Figure 4B:
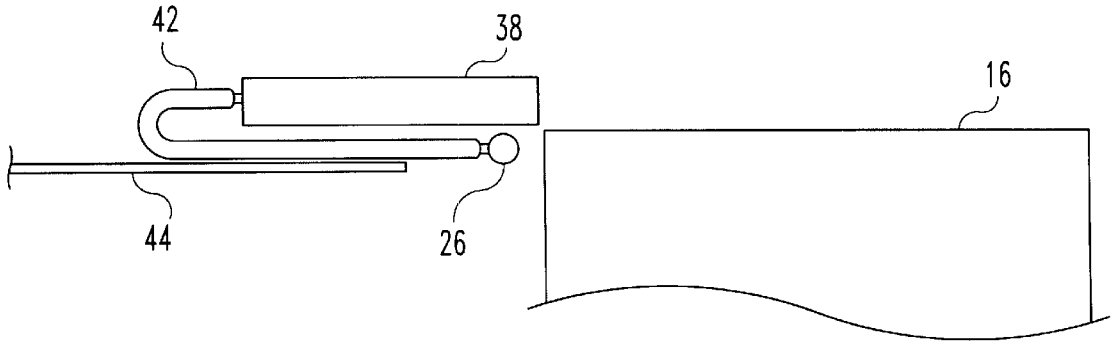

The hoses 42 are provided in a length sufficient to reach between the pipes 26, 28 and the coil unit 38 when the coil unit 38 is moved to a position representing its maximum distance from the pipes 26, 28. In the embodiment shown in FIG. 3, this position is the position illustrated by the lower coil unit 38. Conversely, when the coil unit 38 is moved to be completely within the exhaust path of the stack 16, the hose 42 connections to the coil unit 38 will be very near the hose 42 connections to the pipes 26, 28. Therefore, the hoses 42 will assume a generally U-shaped configuration therebetween. The hoses 42 are supported by a series of trays 44 no matter what position the hoses 44 are placed in. This is illustrated schematically in FIGS. 4A–B. In the view of FIG. 4A, the coil unit 38 is positioned entirely over the stack 16, and the hose 42 assumes its shortest overall dimension. In the view of FIG. 4B, the coil unit 38 has been moved completely away from the stack 16, extending the hose 42 to its longest dimension. In either position, the tray 44 supports a portion of the hose 42, and the U-shaped configuration of the hose 42 allows it to transition between these two extreme positions without kinking.

With the configuration of the heat recovery coil 22 illustrated in FIG. 3, it is possible to actively control the position of the coil units 38 in relation to the temperature of the coil units 38. FIG. 5 illustrates a control system 45 integrated with the heat recovery coil 22 in order to measure the temperature of the coil units 38 and actuate positioning of the heat recovery coils 22. Accordingly, the control system 45 typically includes an electronic controller 46 and a temperature sensor 48 operationally coupled thereto. The sensor 48 may measure the temperature of the heat recovery coils 22 themselves, or the temperature of the heat exchange fluid flowing through the coils 22. The temperature sensor 48 is adapted to send a signal proportional to the temperature of the heat recovery coils 22 (or the fluid therein) to the electronic controller 46. Based upon this signal, the control system 45 may determine whether the coil units 38 should be moved farther into the stack 16 exhaust or farther away therefrom. The control system 45 may activate the motor 40 in order to achieve such movement. For example, upon receipt of a signal exceeding a first predetermined value, the controller 46 may actuate the motor 40 to completely remove the heat recovery coils 22 from the hot zone 17. Alternately, upon receipt of a signal having a second predetermined value, the controller may position the heat recovery coils 22 partially within the hot zone 17. Such control of the position of the heat recovery coil units 38 would not only prevent catastrophic failure of the system in the case of extremely elevated temperatures, but would also allow the temperature of the coil units 38 to be maintained at the optimum temperature for heat recovery. The position of the coil units 38 could therefore be continuously controlled by the control system 45 in order to achieve this optimum temperature. The implementation of such a control system 45 may utilize any appropriate hardware known in the art, and preferably utilizes a PLC control system commercially available from the Allen-Bradley Company.

As a fail-safe safety measure, the heat recovery coil 22 is preferably designed such that failure of the control system 45 will result in the coil units 38 automatically moving out of the exhaust path of the stack 16. It is therefore necessary for the control system 45 to actively command the coil units 38 to be in the path of the exhaust of the stack 16 at all times. Failure of the control system 45 to send such control signals (for example, if there is a loss of power to the control system 45) will result in the coil units 38 automatically retracting away from the exhaust stack 16. If such a fail-safe were not provided, failure of the control system 45 would result in the coil units 38 remaining in the path of the exhaust indefinitely, and could result in a dangerous elevation of temperature.

Several methods for implementing such fail-safe measures may be used. For example, as illustrated in FIG. 6A, the rails of the superstructure 34 upon which the coil unit 38 rolls may be angled away from the stack 16 such that work must be done to keep the coil unit 38 positioned in the hot gas stream. Therefore, upon loss of a control system signal activating the motor 40, gravitational action upon the coil unit 38 will cause it to roll down this inclined ramp, away from the stack 16 and out of the hot gas stream. In this embodiment, the coil units 38 are moved by means of a hydraulic motor 40 which drives a piston attached to the superstructure 34; however, any convenient motor means 40 for moving the coil units 38 may be chosen. This configuration also offers the advantage of presenting an increased coil unit 38 area into the stack 16, such that the energy transfer between the hot gasses in the stack and the heat transfer fluid in the coil unit 38 is increased.

In an alternative embodiment, illustrated in FIG. 6B, a cable 50 may be attached to the side of the coil unit 38 which is opposite to the stack 16. This cable 50 may be routed through a pulley 52 suspended from the superstructure 34 and a large weight 54 attached to the other end of the cable 50. Upon a loss of a command signal from the control system 45 activating the motor 40, there would be nothing counteracting the gravitational pull on the weight 54, and the weight 54 would act to pull the coil unit 38 away from the stack 16. The size of the weight 54 is chosen to provide adequate force to move the coil unit 38. Other methods for automatically moving the coil units 38 away from the stack 16 upon a loss of control signal to the motor 40 will be apparent to those having ordinary skill in the art, and are comprehended by the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A heat recovery system, comprising:

an exhaust stack adapted to constrain flowing hot gasses and defining a hot zone;

a set of heat recovery coils adapted to be at least partially introduced into the hot zone;

a chiller fluidically connected to the set of heat recovery coils;

a heat conducting fluid at least partially filling the coils;

a support structure positioned in the hot zone and adapted to receive the coils;

a motor operationally connected to the set of heat recovery coils and adapted to position the coils in the hot zone; and an electronic controller operationally coupled to the motor;

wherein the hot gasses flowing through the hot zone heat the heat conducting fluid at least partially filling the coils placed in thermal communication with the hot gasses;

wherein the fluid at least partially filling the coils is pressurized to flow through the chillers;

wherein the controller is adapted to control the motor to adjust the positioning of the coils in the hot zone to maintain efficient heat transfer to the heat conducting fluid; and wherein the chillers extract heat from the heat conducting fluid flowing therethrough for transduction into useful energy.

2. The heat recovery system of claim 1 wherein the coils are formed into at least one discrete coil unit.

3. The heat recovery system of claim 1 further including a temperature sensor operationally connected to the controller and positioned to send a signal to the electronic controller proportional to a temperature of the coils.

4. The heat recovery system of claim 1 further including a failsafe configuration operationally coupled to at least one member selected from the group consisting of the exhaust stack, the set of heat recovery coils, the motor, and the electric controller and adapted to remove the coils from the hot zone in the event of failure of power to the system.

5. The heat recovery system of claim 4 wherein the failsafe configuration is actuated in response to a failure of power to the controller.

6. The heat recovery system of claim 4 wherein the failsafe configuration is actuated in response to a failure of power to the motor.

7. The heat recovery system of claim 4 wherein the failsafe configuration further includes a weight, a pulley, and a cable extending over the pulley and connecting the coils to the weight.

8. The heat recovery system of claim 1 including rails on the superstructure adapted to movably receive the coils.

9. The heat recovery system of claim 8 wherein the rails extend in a direction opposite the pull of gravity into the hot zone.

10. The heat recovery system of claim 1 wherein the heat conducting fluid is ammonia.

11. The heat recovery system of claim 1 further including:

a temperature sensor operationally connected to the coils and to the controller and positioned to send a signal to the electronic controller proportional to the temperature of the coils;

a failsafe configuration operationally coupled thereto and adapted to remove the coils from the hot zone in the event of failure of power to the motor; and rails on the superstructure adapted to movably receive the coils;

wherein the heat conducting fluid is ammonia; and wherein the rails extend upwardly into the hot zone.

12. A heat recovery system, including:

a hot zone;

a support structure extending into the hot zone;

at least one heat recovery coil movably connected to the support structure and variably positionable within the hot zone;

a heat transducer in thermal communication with the at least one heat recovery coil; and a motor operationally connected to the at least one heat recovery coil and adapted to position the at least one heat recovery coil in the hot zone;

wherein the at least one heat recovery coil is biased away from the hot zone.

13. The heat recovery system of claim 12 wherein the heat transducer is in fluidic communication with the at least one heat recovery coil and further including a heat conducting fluid extending between the heat transducer and the at least one heat recovery coil.

14. The heat recovery system of claim 12 wherein the support structure extends upwardly into the hot zone, such that gravity acts to bias the at least one heat recovery coil movably connected to the support structure out of the hot zone.

15. The heat recovery system of claim 12 further including:

an electronic controller operationally connected to the motor; and a sensor operationally connecting to the motor and the electronic controller;

wherein the electronic controller is adapted to actuate the positioning of the at least one heat recovery coil within the hot zone, such that the heat recovery coil may be partially positioned in the hot zone.

16. The heat recovery system of claim 13 wherein the heat conducting fluid is ammonia.

17. A method for controlling heat recovery coils in an exhaust stack, comprising the steps of:

providing at least one heat recovery coil at least partially filled with a heat conducting fluid and movable into and out of a hot zone of the exhaust stack;

biasing the at least one heat recovery coil in a direction out of the hot zone;

providing a heat transduction system in fluid communication with the at least one heat recovery coil; and positioning the at least one heat recovery coil in the hot zone.

18. The method of claim 17 further including the steps of:

transferring heat energy from the hot zone into the heat conducting fluid;

flowing the heated heat conducting fluid into the heat transduction system;

removing heat from the heat conducting fluid; and transducing the heat removed from the heat conducting fluid into useful energy.

19. The method of claim 17 further including the steps of:

providing a temperature sensor adapted to measure the temperature of the heat conducting liquid; and positioning the at least one heat recovery coil out of the hot zone when the heat conducting liquid reaches a predetermined temperature.

20. The method of claim 17 further including the steps of:

providing a temperature sensor adapted to measure the temperature of the at least one heat recovery coil; and positioning the at least one heat recovery coil out of the hot zone when the heat conducting liquid reaches a predetermined temperature.

21. The method of claim 17 further including the step of:

positioning the at least one heat recovery coil partially within the hot zone to maintain an optimum temperature of the at least one heat recovery coil.

* * * * *